US008648236B2

(12) United States Patent
Hayashi et al.

(10) Patent No.: US 8,648,236 B2
(45) Date of Patent: Feb. 11, 2014

(54) KEYBOARD APPARATUS

(71) Applicant: Yamaha Corporation, Hamamatsu (JP)

(72) Inventors: Yoshinori Hayashi, Hamamatsu (JP); Akihiko Komatsu, Hamamatsu (JP); Shigeru Muramatsu, Hamamatsu (JP); Hisashi Takeyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/761,008

(22) Filed: Feb. 6, 2013

(65) Prior Publication Data

US 2013/0199356 A1 Aug. 8, 2013

(30) Foreign Application Priority Data

Feb. 6, 2012 (JP) ..... 2012-022920

(51) Int. Cl.
*G10C 3/18* (2006.01)

(52) U.S. Cl.
USPC ..... 84/243

(58) Field of Classification Search
USPC ..... 84/243, 244, 423 R, 430–434, 2, 84/221–223, 234–238
See application file for complete search history.

(56) References Cited

U.S. PATENT DOCUMENTS

2010/0071534 A1* 3/2010 Kitajima et al. ..... 84/439

FOREIGN PATENT DOCUMENTS

JP 04-166994 A 6/1992

* cited by examiner

*Primary Examiner* — Kimberly Lockett
(74) *Attorney, Agent, or Firm* — Morrison & Foerster LLP

(57) ABSTRACT

A keyboard apparatus wherein a hammer body having movable and stationary engagement portions is configured such that, in its pivotal movement in a forward direction, a click feeling in a key depression touch is generated when the movable engagement portion comes into contact with and gets over the stationary engagement portion, wherein a distance from a hammer pivot shaft to the movable engagement portion at a certain key stroke position in a key depression stroke becomes smaller with an increase in a pressing drive force, and wherein the movable engagement portion comes into contact with the stationary engagement portion in the pivotal movement in the forward direction where a magnitude of the pressing drive force is less than a prescribed value, and the movable engagement portion does not come into contact with the same where the magnitude of the force is equal to or larger than the prescribed value.

9 Claims, 3 Drawing Sheets

KEYBOARD APPARATUS

CROSS REFERENCE TO RELATED APPLICATION

The present application claims priority from Japanese Patent Application No. 2012-022920 filed on February 6, the disclosure of which is herein incorporated by reference in its entirety.

BACKGROUND OF THE INVENTION

1. Field of the Invention

The present invention relates to a keyboard apparatus having hammer bodies each configured to impart inertia to a key depressing motion.

2. Description of Related Art

There has been conventionally known a keyboard apparatus having hammer bodies each corresponding to a hammer of an acoustic pianos, for the purpose of imparting inertia to a key depressing motion. Further, there has been known an acoustic piano designed to cause a feeling which approximates to a click feeling generated when a jack escapes in a key depression stroke.

In an apparatus disclosed in the following Patent Literature 1, for instance, a recess or a protrusion for giving the click feeling is provided below a lower surface of a key, and a sliding protrusion or recess is provided on a hammer body so as to correspond to the click-feeling giving recess or protrusion provided on the key. In the key depression stroke, the recess and the protrusion come into sliding contact with each other, thereby generating the click feeling.

In an acoustic piano, a key is depressed in various manners. Where the key is depressed slowly (i.e., in the case of weak key depression), the key and the hammer are held in abutting contact with each other throughout the key depression stroke. Where the key is depressed strongly or quickly beyond a certain level (i.e., in the case of strong key depression), the key is separated from the hammer in the middle of the key depression stroke and the hammer may freely pivot. Accordingly, the jack escape feeling is generated in the weak key depression, but is not generated in the strong key depression.

Patent Literature 1: JP-A-4-166994

SUMMARY OF THE INVENTION

In the apparatus disclosed in the Patent Literature 1, however, the recess and the protrusion come into engagement with each other irrespective of the degree of key depression strength, so that the click feeling is generated also in the strong key depression and a key depression touch becomes different from that of an acoustic piano. On the other hand, where the action of the click generating mechanism is designed moderately in order to obviate the click feeling in the strong key depression, the click feeling in the weak key depression becomes undesirably obscure.

The present invention has been developed to solve the problem described above. It is therefore an object of the invention to provide a keyboard apparatus which is capable of generating a clear click feeling only in the weak key depression.

The object indicated above may be attained according to a principle of the present invention, which provides a keyboard apparatus, comprising:

an instrument main body (20);

a key (K) configured to pivot about a key pivot shaft (27) by a key depressing operation;

a hammer body (HM) having a movable engagement portion (15) configured to move with respect to the instrument main body and a driven portion (12) configured to be drivingly pressed by the key, the key depressing operation causing the driven portion to be drivingly pressed, whereby the hammer body pivots about a hammer pivot shaft (11) so as to impart inertia to the key depressing operation; and a stationary engagement portion (26) fixed to the instrument main body and configured to be engageable with the movable engagement portion of the hammer body, wherein the driven portion receives a pressing drive force, so that the hammer body receives a force to pivot the hammer body in a forward direction and a force to reduce a distance from the hammer pivot shaft to the movable engagement portion, wherein the hammer body is configured such that, in a pivotal movement of the hammer body in the forward direction, a click feeling in a key depression touch is generated when the movable engagement portion comes into contact with and gets over the stationary engagement portion, wherein the distance from the hammer pivot shaft to the movable engagement portion at a certain stroke position of the key in a key depression stroke becomes smaller with an increase in the pressing drive force, and wherein the movable engagement portion comes into contact with the stationary engagement portion in the pivotal movement of the hammer body in the forward direction where a magnitude of the pressing drive force is less than a prescribed value, and the movable engagement portion does not come into contact with the stationary engagement portion in the pivotal movement of the hammer body in the forward direction where the magnitude of the pressing drive force is equal to or larger than the prescribed value.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which:

FIGS. 2A and 2B are graphs each showing a relationship between a key stroke position in a key depression stroke and a reaction force with respect to key depression in the key depression stroke, FIG. 2A being in the case of weak key depression while FIG. 2B is in the case of strong key depression.

DETAILED DESCRIPTION OF THE EMBODIMENTS

There will be hereinafter explained embodiments of the present invention with reference to the drawings.

Figure 1A:
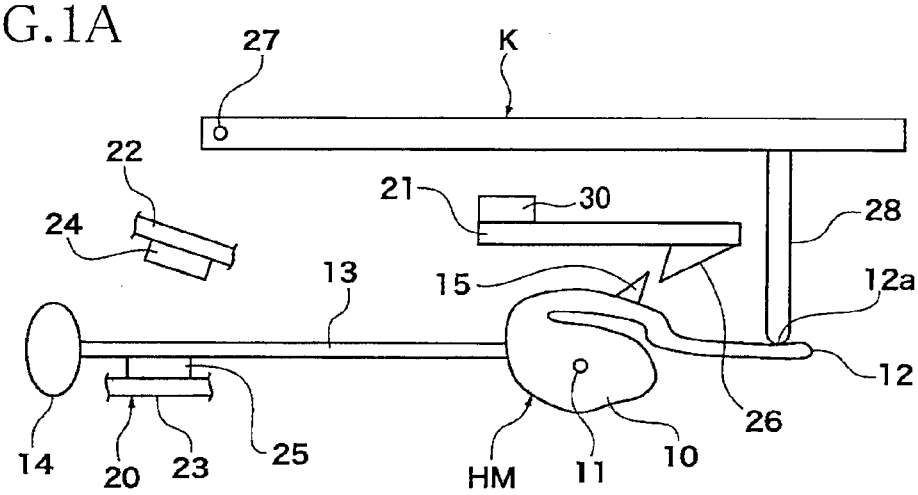
FIG. 1A is a schematic view showing, in side view, a principal part of a keyboard apparatus according to one embodiment of the invention when focusing on one key

FIG. 1A is a schematic view showing, in side view, a principal part of a keyboard apparatus according to one embodiment of the present invention when focusing on one key. The present keyboard apparatus has a plurality of keys K juxtaposed with one another and hammer bodies HM corresponding to the respective keys and is suitable for an electronic keyboard musical instrument. The plurality of keys are constituted by white keys and black keys which are basically identical in construction, and constituent elements corresponding to the white keys and constituent elements corresponding to the black keys are basically identical in construction. In the following explanation, the right side in FIG. 1A is referred to as a front side. The direction perpendicular to the sheet plane of FIG. 1A is referred to as a left-and-right direction. Further, the up-and-down direction in FIG. 1A is referred to an up-and-down direction.

The keyboard apparatus has an instrument main body 20 constituted by a key bed, a chassis, etc. (In FIG. 1A, only a part of the instrument main body 20 is illustrated.) A hammer upper-limit stopper 24 is provided at a rear upper portion 22 of the instrument main body 20 while a hammer lower-limit stopper 25 is provided at a rear lower portion 23 of the instrument main body 20. The key K is provided so as to be pivotable or swingable about a key pivot shaft 27 by a depressing operation of the key K. The key pivot shaft 27 is rotatably supported by the instrument main body 20. At a front portion of the key K, an actuator (a drive-force transmitting member) 28 is provided so as to suspend therefrom.

The hammer body HM is disposed below the associated key K. The hammer body HM has a base portion 10 formed of resin or the like, and a hammer pivot shaft 11 of the base portion 10 is rotatably supported by the instrument main body 20. The hammer body HM is disposed so as to be pivotable or swingable about the hammer pivot shaft 11. The base portion 10 is provided with a rearward extending portion 13 that extends rearward from the base portion 10 and a frontward extending portion 12 that extends frontward from the base portion 10. The hammer body HM has a mass concentration portion 14 at a free end of the rearward extending portion 13. A force in a counterclockwise direction in FIG. 1A is constantly applied to the hammer body HM mainly by the mass of the mass concentration portion 14. The front part of the frontward extending portion 12 of the hammer body HM functions as a driven portion 12*a* configured to receive a pressing drive force from the actuator 28 of the key K in a depressing operation of the key K (key depressing operation).

In a state in which the key K is not depressed (non-key-depression state), the rearward extending portion 13 of the hammer body HM is held in abutting contact with the hammer lower-limit stopper 25 by the own weight of the hammer body HM, and the key K and the hammer body HM are located at an initial position (rest position) shown in FIG. 1A. When the key K is depressed, the actuator 28 of the key K drives the driven portion 12*a*, so that the hammer body HM pivots in a clockwise direction in FIG. 1A so as to impart inertia to the key depressing motion. When the rearward extending portion 13 of the hammer body HM comes into abutting contact with the hammer upper-limit stopper 24, an end position of the pivotal movement of the key K and the hammer body HM (pivotal movement end position) is defined. It is noted that a friction generating member may be provided at the driven portion 12*a*.

In the direction perpendicular to the sheet plane of FIG. 1A, namely, in the left-and-right direction of the instrument main body 20, a support portion 30 which is a part of the instrument main body 20 is provided over the range in which the plurality of keys K are disposed. A stationary engagement portion 26 is fixed to a front support portion 21 supported by the support portion 30. While, in the present embodiment, the stationary engagement portion 26 and the front half portion 21 are provided for each of the plurality of keys K, one stationary engagement portion 26 will be explained here. The stationary engagement portion 26 is formed of a member having elasticity such as rubber and is disposed between the key K and the hammer body HM in the up-and-down direction. In the front-and-rear direction, the stationary engagement portion 26 is disposed between the actuator 28 and the hammer pivot shaft 11. While, in the present embodiment, the stationary engagement portion 26 is provided for each of the plurality of keys K, there may be provided one stationary engagement portion for the plurality of keys K that extends in the left-and-right direction over the range in which the plurality of keys K are arranged. As shown in FIG. 1A, the stationary engagement portion 26 is formed so as to be convex toward a movable engagement portion 15 which will be explained and is fixed to the front half portion 21.

Figure 1B:
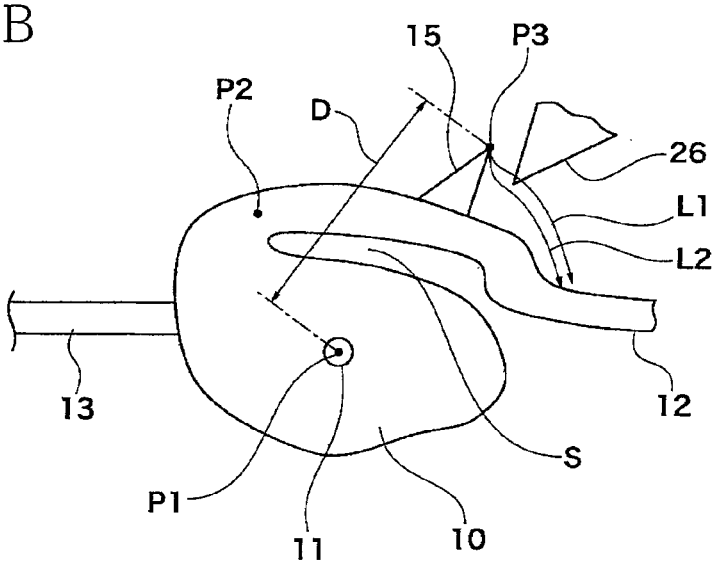
FIG. 1B is an enlarged view showing a vicinity of a base portion of a hammer body of the keyboard apparatus.

FIG. 1B is an enlarged view showing the vicinity of the base portion 10 of the hammer body HM.

In the present embodiment, the frontward extending portion 12 is formed integrally with the base portion 10. The frontward extending portion 12 may be formed separately from the base portion 10. The frontward extending portion 12 extends frontward from a support position P2 such that a space S is formed between the frontward extending portion and a main part of the base portion 10. The frontward extending portion 12 may be regarded as a cantilever in which the proximal portion is the support position P2. The position of the support position P2 is upward of and rearward of a center position P1 of the hammer pivot shaft 11. The frontward extending portion 12 has flexibility and elasticity.

In the frontward extending portion 12, the movable engagement portion 15 is provided between the support position P2 and the driven portion 12*a*. The movable engagement portion 15 is formed integrally with the frontward extending portion 12, resulting in a simple structure. The movable engagement portion 15 has elasticity. As the movable engagement portion 15, a separate member having elasticity and high wear resistance such as hard rubber may be employed and fixed to the frontward extending portion 12. In the non-key-depression state, a tip P3 of the movable engagement portion 15 is located upward of and frontward of the center position P1. As shown in FIG. 1A, the movable engagement portion 15 is formed so as to be convex toward the stationary engagement portion 26 and is fixed to the frontward extending portion 12.

Supposing that the base portion 10 is kept fixed so as not to pivot about the hammer pivot shaft 11 and the driven portion 12*a* receives a pressing drive force, the frontward extending portion 12 bends or flexes downward, owing to its elasticity, about the support position P2 as a fulcrum. By the pressing drive force that the driven portion 12*a* receives from the actuator 28, rotation moment about the support position P2 in the clockwise direction acts on the base portion 10, so that the base portion 10 tends to pivot about the hammer pivot shaft 11. Since the base portion 10 is actually pivotable, the base portion 10 pivots in a forward direction corresponding to a direction in which the key is depressed (key depression direction), by the rotation moment.

The hammer body HM has relatively large inertia. Accordingly, the flexure amount of the frontward extending portion 12 varies depending upon the key depression strength (speed) even where the key K is depressed to the same stroke position, namely, even in a state in which the stroke position of the key K in a key depression stroke is located at a certain position. Where the key is slowly depressed, namely, in the case of weak key depression, the hammer body HM is pivotally displaced to a position that substantially corresponds to the stroke position of the key K in the key depression stroke. Accordingly, the flexure amount of the frontward extending portion 12 is small since the influence of the inertia of the hammer body HM is not large.

On the other hand, where the key is depressed strongly or quickly, namely, in the case of strong key depression, the influence of the inertia of the hammer body HM is large. Accordingly, the frontward extending portion 12 largely bends or flexes before the hammer body HM sufficiently pivots in the key depression stroke, so that the flexure amount of the frontward extending portion 12 is large.

As shown in FIG. 1B, each of the movable engagement portion 15 and the stationary engagement portion 26 has a tapered triangular shape in side view, namely, as seen from the key arrangement direction in which the plurality of keys K are arranged. The stationary engagement portion 26 is pointed downward while the movable engagement portion 15 is pointed upward. The stationary engagement portion 26 and the movable engagement portion 15 overlap each other as seen from the front side. In other words, a distance from the center position P1 of the hammer pivot shaft 11 to the stationary engagement portion 26, more specifically, to a tip of the stationary engagement portion 26, is smaller than a distance D from the center position P1 of the hammer pivot shaft 11 to a tip P3 of the movable engagement portion 15. The distance D form the center position P1 of the hammer pivot shaft 11 to the tip P3 of the movable engagement portion 15 varies by flexure deformation of the frontward extending portion 12 in accordance with the key depressing operation.

The pressing drive force that the driven portion 12*a* receives from the actuator 28 causes the hammer body HM to undergo a force to pivot the hammer body HM in the forward direction about the hammer pivot shaft 11 and causes the hammer body HM to undergo a force to reduce the distance D.

As described above, in the non-key-depression state, the distance D is larger than the distance from the center position P1 to the tip of the stationary engagement portion 26 which is constant. However, since the flexure amount of the frontward extending portion 12 varies depending upon the degree of the key depression strength as described above, a movement locus of the tip P3 changes. In particular, the distance D when the tip P3 of the movable engagement portion 15 is located the closest to the stationary engagement portion 26 varies depending upon the degree of the key depression strength.

Here, a certain value of the key depression speed (or a certain magnitude of the pressing drive force) that defines a boundary between an instance in which the click feeling is generated in an acoustic piano and an instance in which the click feeling is not generated in an acoustic piano is referred to as a "prescribed value". In the present embodiment, a key depressing operation with the pressing drive force less than the prescribed value is referred to as "weak key depression", and a key depressing operation with the pressing drive force equal to or larger than the prescribed value is referred to as "strong key depression".

Accordingly, the weak key depression is the key depressing operation at a very slow speed (e.g., about 2 mm/sec), and is similar to key depression in an acoustic piano in which a click feeling is generated when a jack escapes in the key depression stroke. On the other hand, the strong key depression is similar to key depression in an acoustic piano in which the key separates away from the hammer in the middle of the key depression stroke and the hammer freely pivots.

In the present embodiment, as shown in FIG. 1B, the movement locus of the tip P3 of the movable engagement portion 15 in the key depression stroke follows a curved line L1 in the weak key depression and follows a curved line L2 in the strong key depression. In the weak key depression, as shown in FIG. 1B, the distance D is larger than the distance from the center position P1 of the hammer pivot shaft 11 to the tip of the stationary engagement portion 26. When the movable engagement portion 15 moves such that the tip P3 of the movable engagement portion 15 follows the curved line L1 in the key depression stroke, the tip P3 comes into abutting contact with the stationary engagement portion 26, namely, the tip P3 interferes or contacts the stationary engagement portion 26, and gets over the stationary engagement portion 26 owing to a transient change in elastic deformation of the frontward extending portion 12 (more strictly, deformation of the movable engagement portion 15 and the stationary engagement portion 26 is added).

When the movable engagement portion 15 gets over the stationary engagement portion 26, a load, namely, a reaction force with respect to the key depression, temporarily increases. This increase in the reaction force is felt by the player as the click feeling in a key depression touch.

On the other hand, where the movable engagement portion 15 moves such that the tip P3 of the movable engagement portion 15 follows the curved line L2 in the key depression stroke, the tip P3 passes a more inward region nearer to the center position P1, as compared when the tip P3 follows the curved line L1. Accordingly, the movable engagement portion 15 does not come into contact with the stationary engagement portion 26. In other words, in the strong key depression, the distance D is smaller than the distance from the center position P1 of the hammer pivot shaft 11 to the tip of the stationary engagement portion 26, as shown in FIG. 1B. Therefore, the player does not feel the click feeling in the strong key depression. The positional relationship between the movable engagement portion 15 and the stationary engagement portion 26 is thus determined.

Figure 2A:
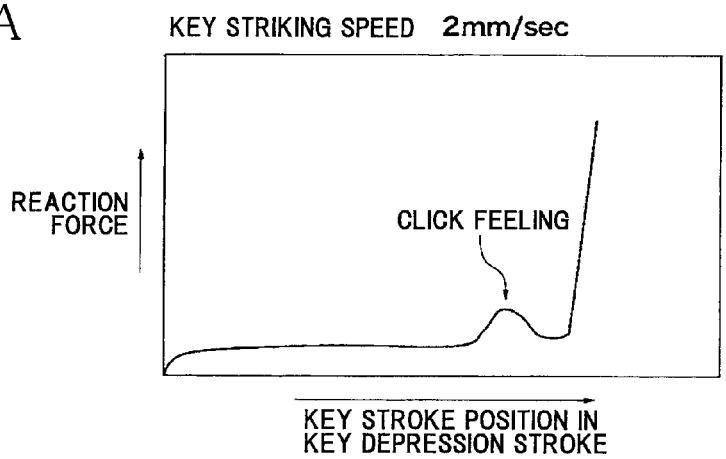
Figure 2B:
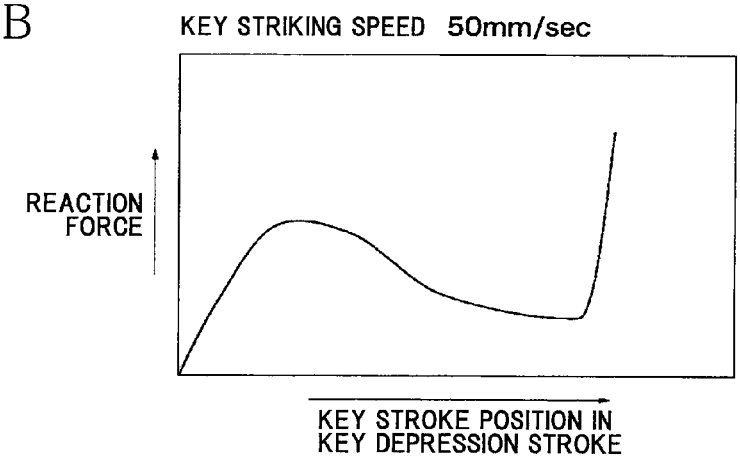

FIG. 2A is a graph showing a relationship between key stroke position in key depression stroke and reaction force with respect to key depression, in the weak key depression. FIG. 2B is a graph showing a relationship between key stroke position in key depression stroke and reaction force with respect to key depression, in the strong key depression. In the weak key depression, the reaction force temporarily increases in the middle of the key depression stroke, as indicated by a bump-like portion in the graph of FIG. 2A. On the other hand, in the initial period of the key depressing operation in the strong key depression, the initial reaction force is large since the inertial mass of the hammer body HM acts as a reaction force. However, as shown in FIG. 2B, the reaction force does not temporarily increase thereafter in the bump-like manner.

According to the present embodiment, in the key depression stroke, the larger the pressing drive force, the smaller the distance D at the same key stroke position, owing to the inertial fore of the hammer body HM. Where the magnitude of the pressing drive force is less than the prescribed value, the movable engagement portion 15 comes into abutting contact with the stationary engagement portion 26. On the other hand, where the magnitude of the pressing drive force is equal to or larger than the prescribed value, the movable engagement portion 15 does not come into abutting contact with the stationary engagement portion 26. According to the arrangement, it is possible to generate a clear click feeling only in the weak key depression without generating the click feeling in the strong key depression, so that the key depression touch becomes closer to that of the acoustic piano.

In the present embodiment, the movement locus of the movable engagement portion 15 is made different depending upon the degree of the key depression strength mainly by the flexure of the frontward extending portion 12. The movement locus of the movable engagement portion 15 may be made different by factors other than the flexure of the frontward extending portion 12, as explained below with respect to modified embodiment shown in FIG. 3A.

Figure 3A:
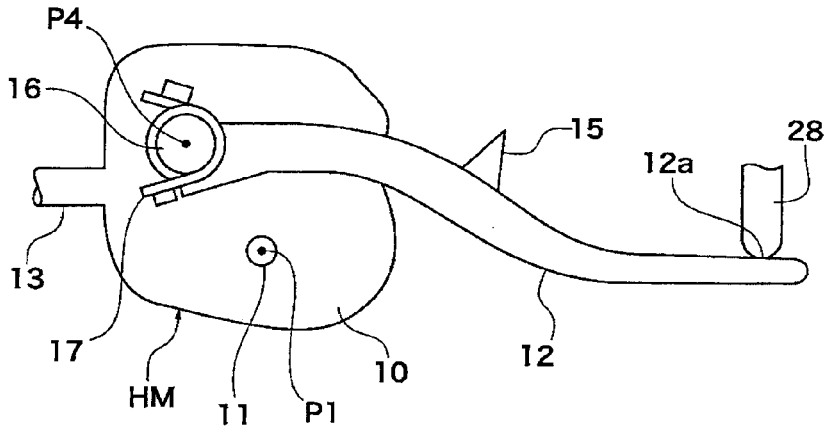
FIG. 3A is an enlarged view showing a vicinity of a base portion of a hammer body according to a modified embodiment and FIG. 3B is an enlarged view showing a relation between a movable engagement portion and a stationary engagement portion according to a modified embodiment.

FIG. 3A is an enlarged view showing the vicinity of the base portion 10 of a hammer body HM according to the modified embodiment. As shown in this modified embodiment, the frontward extending portion 12 is not formed so as to extend integrally from the base portion 10, but is formed as a separate member and is pivotally fixed to a support portion 16 provided at the base portion 10. The support portion 16 is provided on both of opposite surfaces of the base portion 10. The frontward extending portion 12 is pivotable about a rotation center P4 that corresponds to the support position P2 (FIG. 1B). Between the proximal portion of the frontward extending portion 12 and the support portion 16, a torsion spring 17 is installed. When the frontward extending portion 12 pivots in the clockwise direction from the initial position shown in FIG. 3A, there acts, on the frontward extending portion 12, a force in a direction in which the torsion spring 17 returns, in other words, a force in which the frontward extending portion 12 returns to the initial position, owing to the torsion spring 17.

When the frontward extending portion 12 pivots about the rotation center P4 in the clockwise direction, the movable engagement portion 15 is displaced as in the embodiment of FIG. 1. In this modified embodiment of FIG. 3A, by the pressing drive force that the driven portion 12*a* receives from the actuator 28, there act, on the hammer body HM, a force to pivot the hammer body HM about the hammer pivot shaft 11 in the forward direction and a force to reduce the distance D, owing to the elasticity of the torsion spring 17. The smaller the pressing drive force, the smaller the pivotal amount of the frontward extending portion 12 with respect to the base portion 10. The relationship between the pressing drive force and the movement locus of the tip P3 is similar to that in the embodiment of FIG. 1. The advantageous effect of the present invention can be obtained even in this arrangement in which the proximal portion of the frontward extending portion 12 is configured to be elastically pivotable with respect to the base portion 10. Therefore, in this arrangement, the frontward extending portion 12 does not necessarily have flexibility and elasticity.

In the embodiments illustrated above, the shape of each of the movable engagement portion 15 and the stationary engagement portion 26 is not limited to the illustrated one, but may be any shape as long as the movable engagement portion 15 gets over the stationary engagement portion 26. Further, the movable engagement portion 15 and the stationary engagement portion 26 may be configured such that the tip of one of the movable engagement portion 15 and the stationary engagement portion 26 comes into abutting contact with a surface of the other of the movable engagement portion 15 and the stationary engagement portion 26.

Figure 3B:
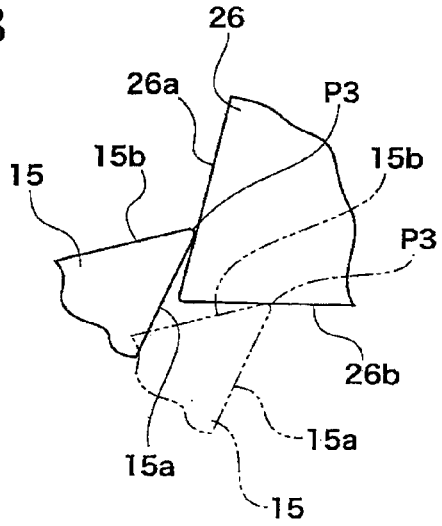

For instance, as shown in FIG. 3B, the tip P3 of the movable engagement portion 15 may be arranged so as to come into sliding contact with a surface of the stationary engagement portion 26 in each of the key depressing stroke and a key release stroke. More specifically, in the arrangement shown in FIG. 3B, the tip P3 of the movable engagement portion 15 comes into sliding contact with a contact surface 26*a* of the stationary engagement portion 26 in the key depressing stroke while the tip P3 of the movable engagement portion 15 comes into sliding contact with a contact surface 26*b* of the same 26 in the key release stroke. However, the combination of the tip and the contact surface which come into sliding contact with each other in the key depression stroke and that in the key release stroke may be reversed. More specifically, in the key depression stroke, the tip of one of the movable engagement portion 15 and the stationary engagement portion 26 may come into abutting contact with the contact surface of the other of the movable engagement portion 15 and the stationary engagement portion 26 while, in the key release stroke, the tip of the other of the movable engagement portion 15 and the stationary engagement portion 26 may come into abutting contact with the contact surface of the one of the movable engagement portion 15 and the stationary engagement portion 26.

In the key release stroke, the click feeling is not necessary. Accordingly, for permitting the movable engagement portion 15 to smoothly get over the stationary engagement portion 26 in the key release stroke, i.e., in a reverse stroke of the hammer body HM, the movable engagement portion 15 and the stationary engagement portion 26 may be configured as indicated in FIG. 3B, for instance. That is, an angle formed by a contact surface 15*a* of the movable engagement portion 15 and the contact surface 26*a* of the stationary engagement portion 26 which is to be opposed to each other in the key depression stroke is made smaller than an angle formed by the contact surface 15*b* of the movable engagement portion 15 and the contact surface 26*b* of the stationary engagement portion 26 which is to be opposed to each other in the key release stroke.

According to the arrangement described above, where the movable engagement portion 15 comes into contact with the stationary engagement portion 26 with the distance D (FIG. 1B) kept in mutually the same state in the key depression stroke and the key release stroke, the load when the movable engagement portion 15 gets over the stationary engagement portion 26 is smaller in the key release stroke than in the key depression stroke. It is therefore possible to suppress an uncomfortable or unnatural feeling which would be otherwise felt by the player in the key release stroke.

While the embodiments of the present invention have been described above, it is to be understood that the invention is not limited to the details of the embodiments, but may be embodied otherwise without departing from the scope of the invention defined in the following claims.

In the illustrated embodiments, the movable engagement portion 15 is provided between the driven portion 12*a* and the support position P2 which is the proximal portion of the frontward extending portion 12. The movable engagement portion may be provided at a position on the frontward extending portion 12 which is located on a distal side with respect to the driven portion 12*a*, in other words, thee movable engagement portion may be provided on one side of the driven portion 12*a* that is opposite to the other side of the same 12*a* on which the support position P2 is located.

What is claimed is:

1. A keyboard apparatus, comprising:

an instrument main body;

a key configured to pivot about a key pivot shaft by a key depressing operation;

a hammer body having a movable engagement portion configured to move with respect to the instrument main body and a driven portion configured to be drivingly pressed by the key, the key depressing operation causing the driven portion to be drivingly pressed, whereby the hammer body pivots about a hammer pivot shaft so as to impart inertia to the key depressing operation; and a stationary engagement portion fixed to the instrument main body and configured to be engageable with the movable engagement portion of the hammer body, wherein the driven portion receives a pressing drive force, so that the hammer body receives a force to pivot the hammer body in a forward direction and a force to reduce a distance from the hammer pivot shaft to the movable engagement portion, wherein the hammer body is configured such that, in a pivotal movement of the hammer body in the forward direction, a click feeling in a key depression touch is generated when the movable engagement portion comes into contact with and gets over the stationary engagement portion, wherein the distance from the hammer pivot shaft to the movable engagement portion at a certain stroke position of the key in a key depression stroke becomes smaller with an increase in the pressing drive force, and wherein the movable engagement portion comes into contact with the stationary engagement portion in the pivotal movement of the hammer body in the forward direction where a magnitude of the pressing drive force is less than a prescribed value, and the movable engagement portion does not come into contact with the stationary engagement portion in the pivotal movement of the hammer body in the forward direction where the magnitude of the pressing drive force is equal to or larger than the prescribed value.

2. The keyboard apparatus according to claim 1, wherein the distance from the hammer pivot shaft to the movable engagement portion is larger than a distance from the hammer pivot shaft to the stationary engagement portion, where the magnitude of the pressing drive force in the key depression stroke is less than the prescribed value.

3. The keyboard apparatus according to claim 1, wherein the hammer body has a base portion rotatably supported with respect to the instrument main body by the hammer pivot shaft, wherein a part of an extending portion that extends from the base portion is the driven portion, and wherein the movable engagement portion is provided at the extending portion.

4. The keyboard apparatus according to claim 3, wherein the movable engagement portion is provided between a proximal portion of the extending portion and the driven portion.

5. The keyboard apparatus according to claim 3, wherein the extending portion is configured such that the distance from the hammer pivot shaft to the movable engagement portion changes by the pressing drive force given to the driven portion.

6. The keyboard apparatus according to claim 3, wherein the extending portion has flexibility, and wherein the distance from the hammer pivot shaft to the movable engagement portion changes by elastic deformation of the extending portion.

7. The keyboard apparatus according to claim 1, wherein the movable engagement portion has a shape that is convex toward the stationary engagement portion.

8. The keyboard apparatus according to claim 7, wherein the stationary engagement portion has a shape that is convex toward the movable engagement portion.

9. The keyboard apparatus according to claim 1, wherein, where the movable engagement portion comes into contact with the stationary engagement portion such that the distance from the hammer pivot shaft to the movable engagement portion in the key depression stroke and the distance from the hammer pivot shaft to the movable engagement portion in a key release stroke are mutually the same, an angle, in side view, defined by a contact surface of the movable engagement portion and a contact surface of the stationary engagement portion which come into contact with each other is determined such that a load when the movable engagement portion gets over the stationary engagement portion in the key depression stroke is larger than a load when the movable engagement portion gets over the stationary engagement portion in the key release stroke.

* * * * *